United States Patent [19]

Focke

[11] Patent Number: 5,004,396

[45] Date of Patent: Apr. 2, 1991

[54] APPARATUS FOR THE FEEDING OF (PACK) BLANKS TO A PACKAGING MACHINE

[75] Inventor: Heinz Focke, Verden, Fed. Rep. of Germany

[73] Assignee: Focke & Co., (GmbH & Co.), Verden, Fed. Rep. of Germany

[21] Appl. No.: 387,666

[22] Filed: Jul. 31, 1989

[30] Foreign Application Priority Data

Aug. 17, 1988 [DE] Fed. Rep. of Germany ..... 3827915

[51] Int. Cl.[5] ..... B65B 43/12

[52] U.S. Cl. ..... 414/417; 198/465.4

[58] Field of Search ..... 414/403, 416, 417; 198/465.4, 468.8, 468.1, 468.6, 742

[56] References Cited

U.S. PATENT DOCUMENTS

| | | | |
|---|---|---|---|
| 2,681,758 | 6/1954 | Lipson | 198/468.1 X |
| 4,040,533 | 8/1977 | De Boer et al. | 414/417 |
| 4,048,784 | 9/1977 | Toby | 198/468.6 X |
| 4,194,614 | 3/1980 | Hrivnak | 198/468.1 |
| 4,273,496 | 6/1981 | Papalexis | 414/417 |
| 4,492,503 | 1/1985 | Thomas et al. | 198/468.8 X |
| 4,548,313 | 10/1985 | Occhialini et al. | 198/468.1 X |
| 4,776,742 | 10/1988 | Felder | 414/417 X |

FOREIGN PATENT DOCUMENTS

| | | | |
|---|---|---|---|
| 2202525 | 7/1973 | Fed. Rep. of Germany . | |
| 2508841 | 9/1976 | Fed. Rep. of Germany | 198/468.8 |
| 3442893 | 6/1985 | Fed. Rep. of Germany . | |
| 3615309 | 11/1986 | Fed. Rep. of Germany . | |
| 3519580 | 3/1987 | Fed. Rep. of Germany . | |
| 3307675 | 10/1987 | Fed. Rep. of Germany . | |
| 3627868 | 2/1988 | Fed. Rep. of Germany . | |
| 3628952 | 3/1988 | Fed. Rep. of Germany . | |
| 3638806 | 12/1988 | Fed. Rep. of Germany . | |
| 113196 | 5/1975 | German Democratic Rep. . | |
| 546194 | 2/1974 | Switzerland . | |

*Primary Examiner*—David A. Bucci

*Attorney, Agent, or Firm*—Sughrue, Mion, Zinn, Macpeak & Seas

[57] ABSTRACT

Apparatus for the feeding of stacks of blanks to a blank magazine. The supply of high-performance packaging machines (21) with packaging material presents a special problem. This applies, above all, to blanks (20) which are made outside the region of the packaging machine (21), especially in a paper factory, and which are delivered as blank stacks (22). For an efficient supply of a packaging machine (21) with stacked blanks (20), containers, particularly cassettes (26), open at the top and having several blank stacks (22) next to one another are used. The cassettes (26) are deposited by an appropriate automatic conveyor on a cassette conveyor (31) which is located at the machine and is arranged at the rear of the packaging machine (21) and which at the same time serves as a store for a relatively large number of filled cassettes (26). In the region of an emptying station (36), the blank stacks (22) are extracted from the cassettes (26) in succession and, as a result of an upward movement and a subsequent transverse movement, are fed to one or more blank magazines (23, 24) of the packaging machine (21). The transfer of the blank stacks (22) to a blank magazine (23, 24) takes place in a special way, particularly by a stack pocket (71) which moves into the blank magazine (23, 24) and which is tiltable for the transfer of the blank stack (22).

17 Claims, 11 Drawing Sheets

APPARATUS FOR THE FEEDING OF (PACK) BLANKS TO A PACKAGING MACHINE

Figure 1:
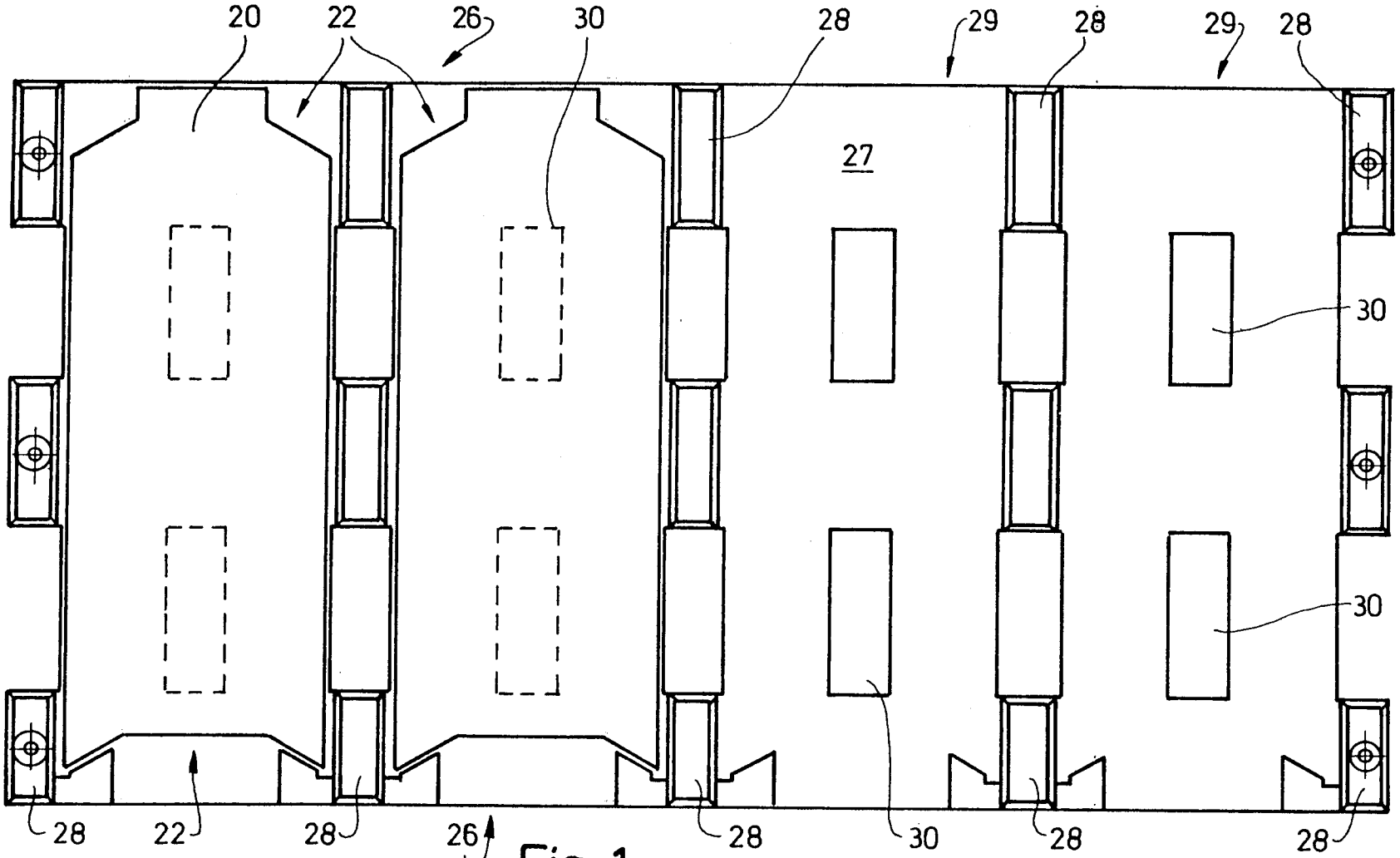

The invention relates to an apparatus for the feeding of stacks of (pack) blanks (blank stacks) to a blank magazine of a packaging machine, especially for the production of hinge-lid packs for cigarettes.

For the production of specific packs, for example hinge-lid packs for cigarettes, it is necessary or customary to supply the packaging machine with blanks produced elsewhere and in the form of blank stacks. Conventionally, these blanks are made by punching in a paper factory. The packaging machine is equipped with a blank magazine (or several of these) into which the blank stacks are conveyed. The extraction of the individual blanks for the folding of the packs takes place on the underside of the blank magazine.

Supplying packaging machines of increasingly high performance with appropriate amounts of packaging material presents problems This applies, above all, to the blank stacks which are difficult to handle. Hitherto, these have mainly been handled manually, in particular introduced into the blank magazine in stack form.

The object on which the invention is based is to propose an apparatus, by means of which the handling of the blanks or blank stacks in the region of the packaging machine becomes easier and more efficient, with manual labor largely being avoided.

To achieve this object, the apparatus according to the invention is characterized in that containers (cassettes) open at least at the top and with several blank stacks can be fed, on a cassette conveyor arranged on the packaging machine, to an emptying station in which the blank stacks can be extracted from the container (cassette) and transferred to the blank magazine.

The cassettes used according to the invention are containers with chambers, each for receiving a blank stack. The loading of the cassettes takes place centrally, preferably at the production location of the blanks. The cassettes can be delivered to the packaging machine on pallets and placed in succession, for example by hand, onto the cassette conveyor designed as a band conveyor.

However, it is more advantageous and more efficient to couple the packaging machine or the cassette conveyor to a conveying system with at least one overhead conveyor, by means of which the cassettes are conveyed individually to the cassette conveyor and deposited on this by a vertical conveyor. In this alternative, there is no need for any manual labor.

The cassettes stand close to one another on the cassette conveyor, so that the latter, because of the length, at the same time constitutes a high-capacity store.

Preferably, the cassette conveyor is arranged at the rear of the packaging machine and extends approximately parallel to the longitudinal mid-plane of the latter. In the region of the emptying station, the blank stacks are extracted from the cassettes in succession as a result of an upward movement.

The path of movement of the blank stacks runs in a plane above the packaging machine transversely relative to this or transversely relative to the cassette conveyor to the front side or the front region of the packaging machine. Here, as required, the blank stacks are transferred preferably to two blank magazines.

The emptied cassettes are transported beyond the emptying station on the cassette conveyor and either loaded on pallets or returned to the circuit of the overhead conveyor.

The cassettes are appropriately designed so that several emptied cassettes can be nested in one another in a space-saving way, with the result that only a small amount of space is required for the return transport to a filling station.

Further features of the invention relate to the design and arrangement of the cassette conveyor and conveying members following this for the transport of the blank stacks as far as the blank magazines. Furthermore, the invention relates to the mechanized feed of the cassettes to the cassette conveyor and to the transporting away of the emptied cassettes.

Figure 2:
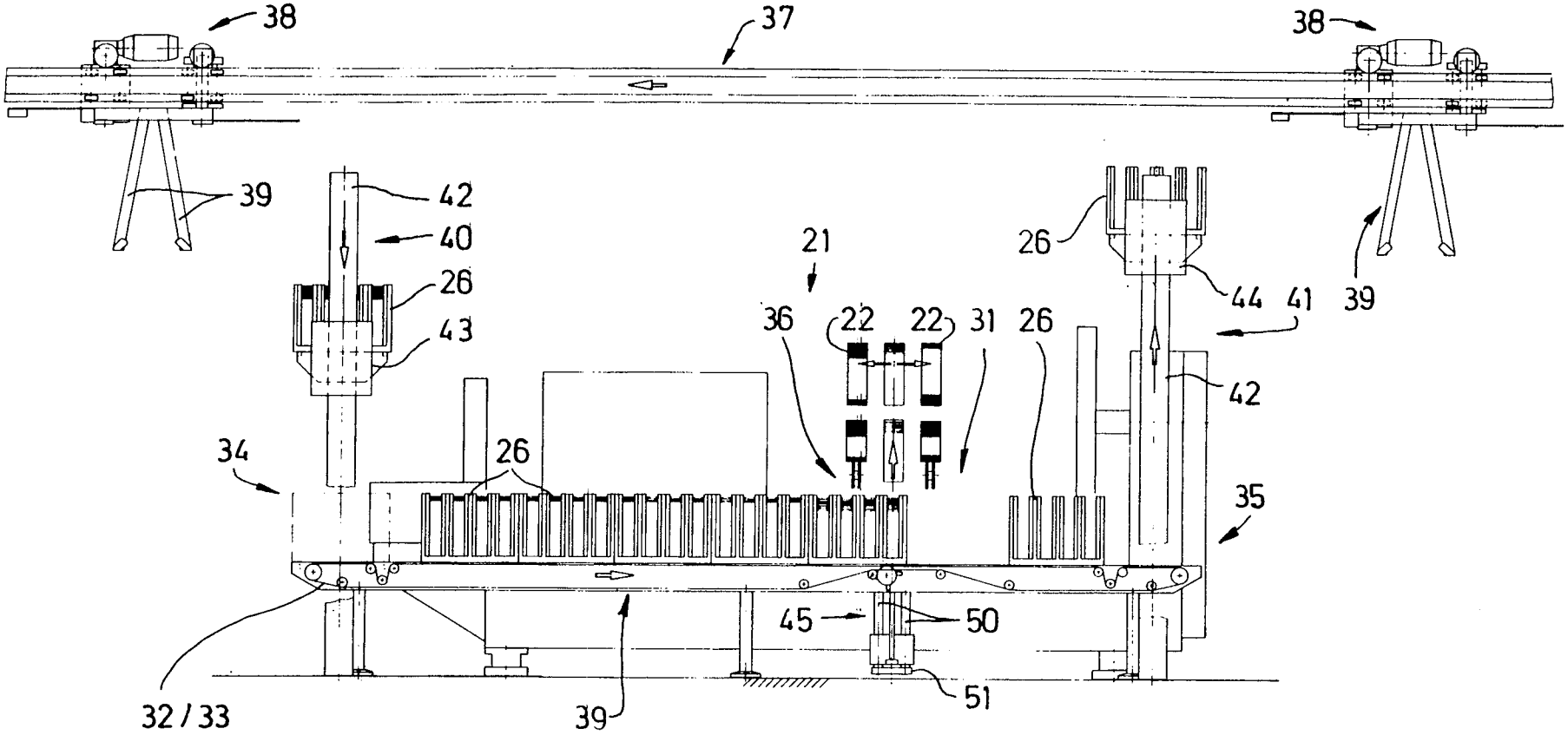
Figure 3:
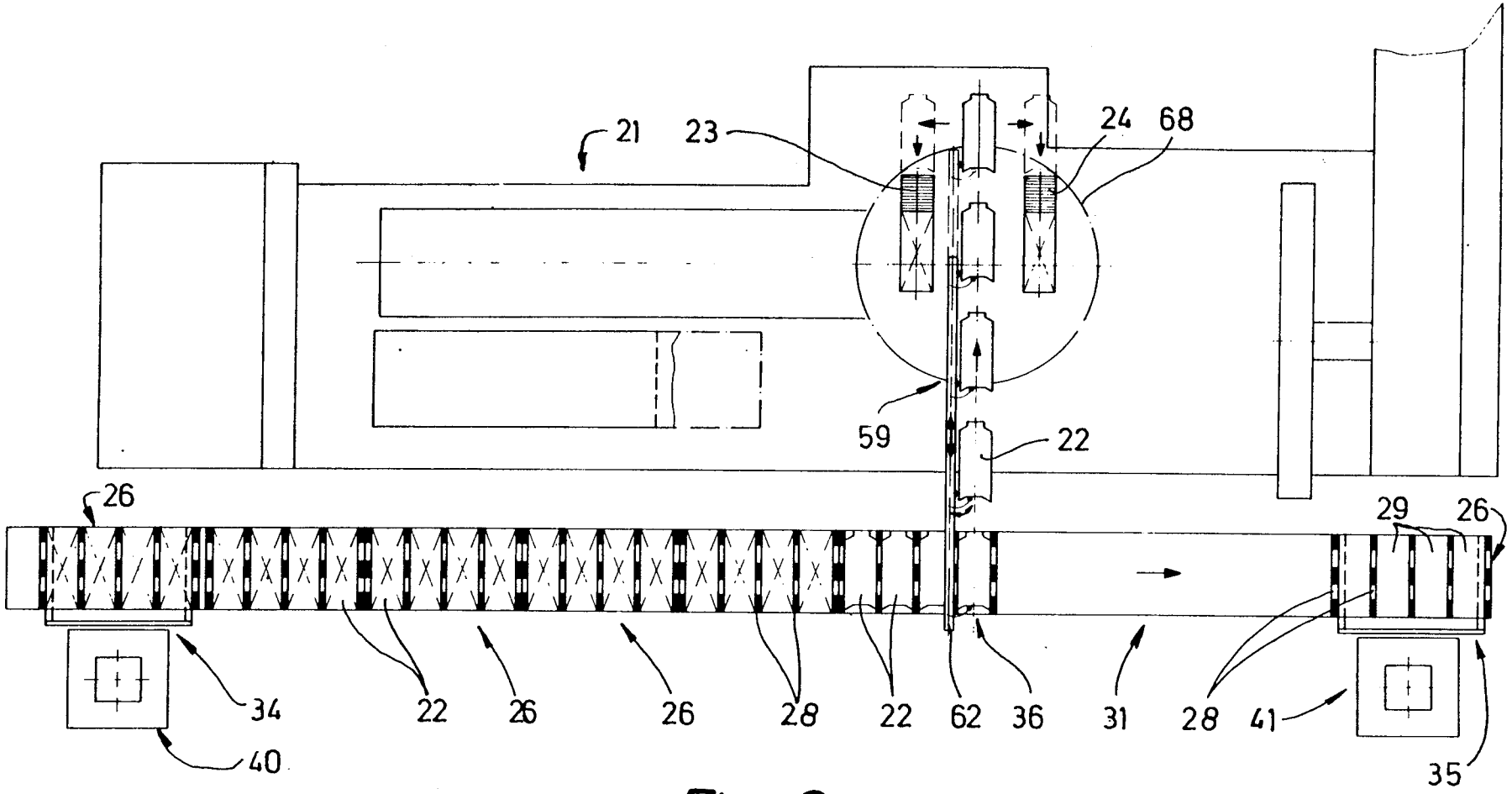
Figure 4:
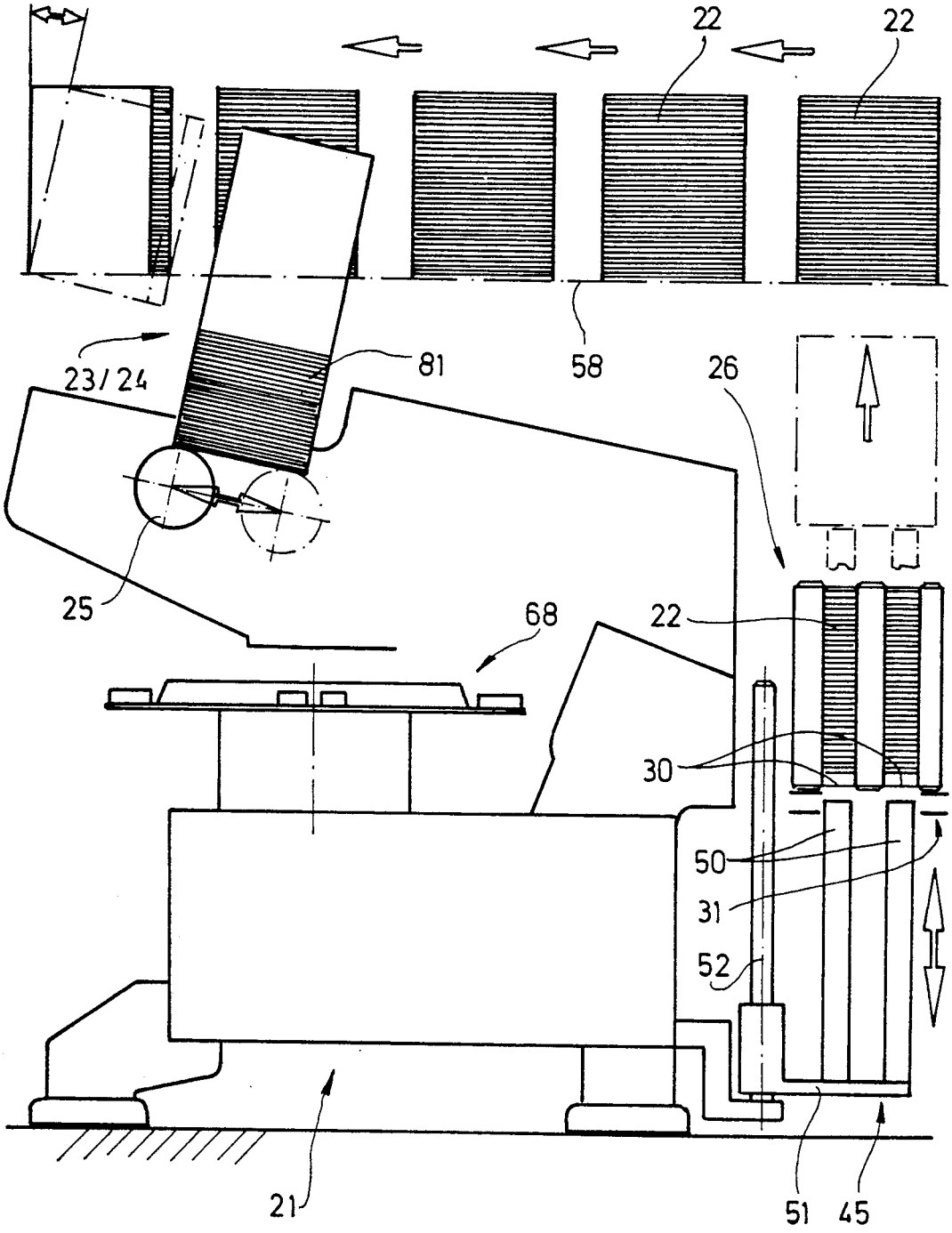
Figure 5:
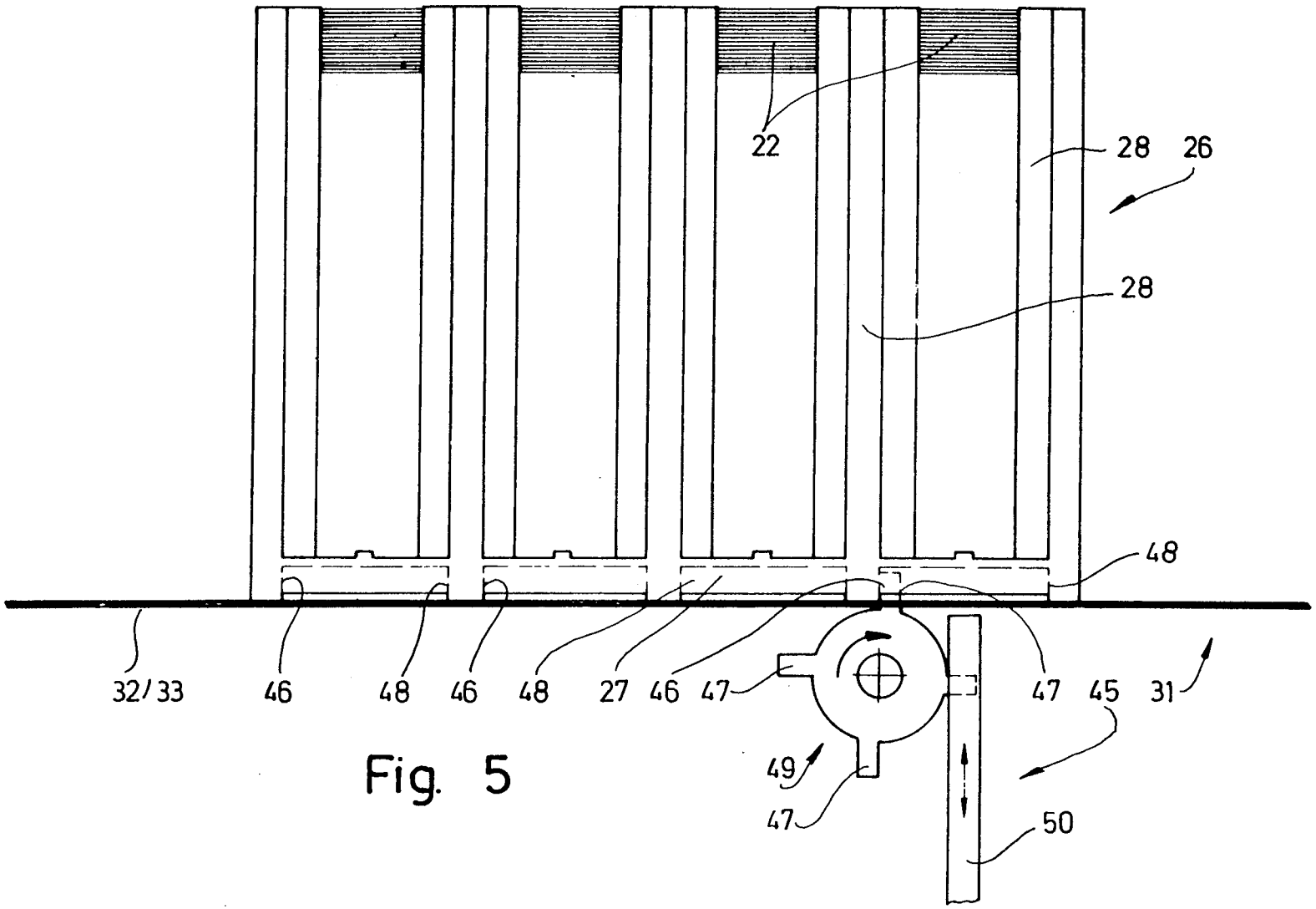
Figure 6:
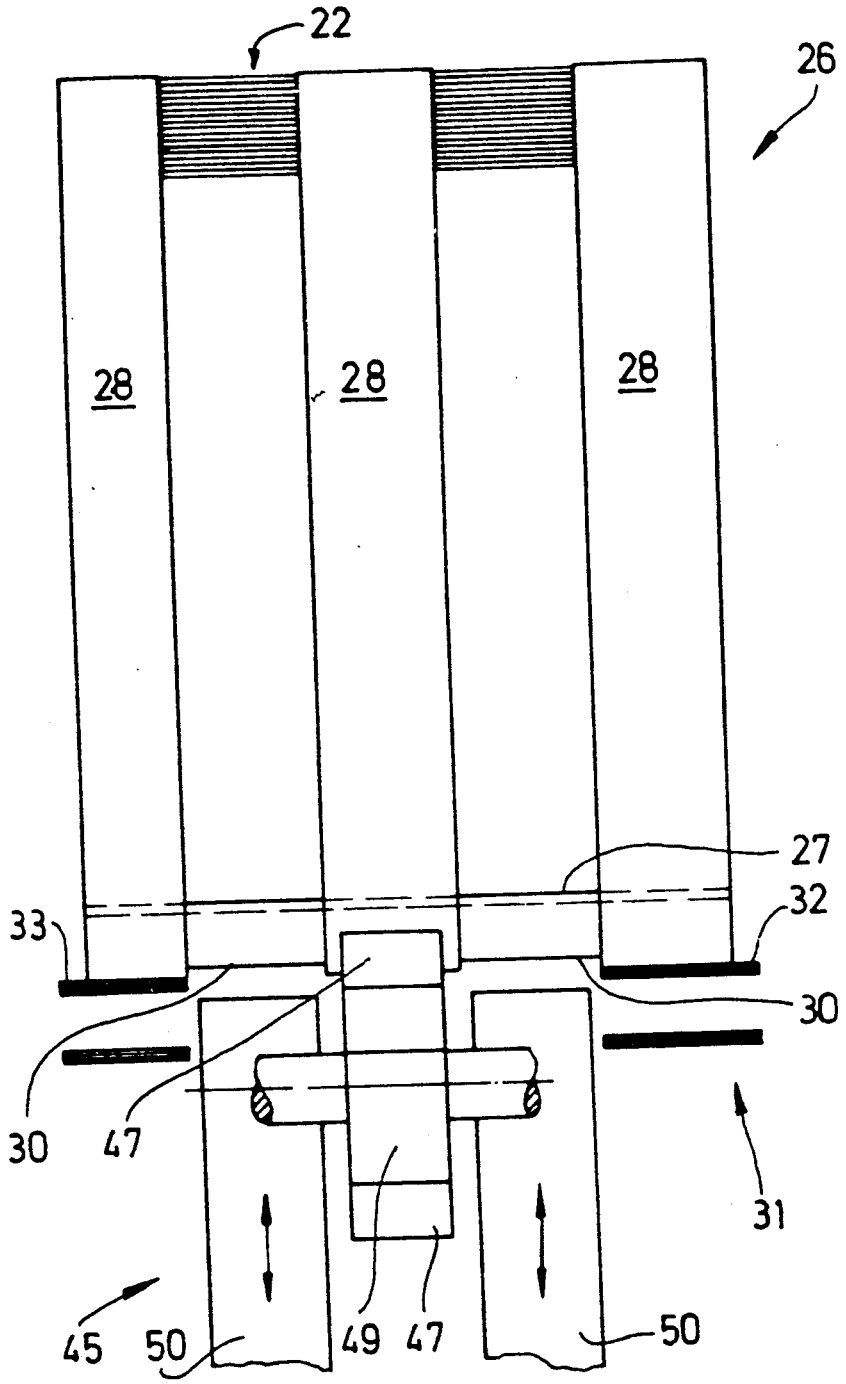
Figure 7:
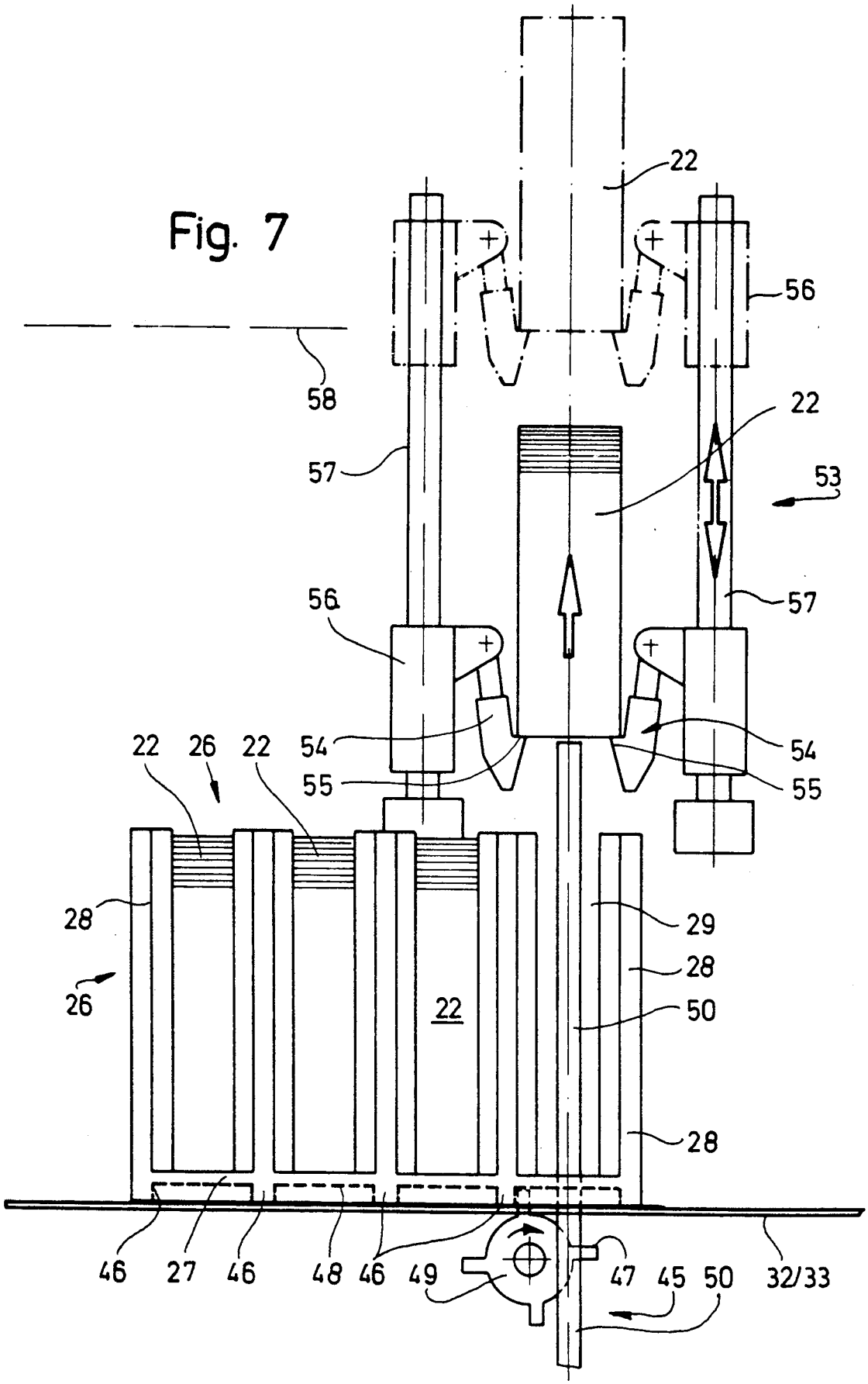
Figure 8:
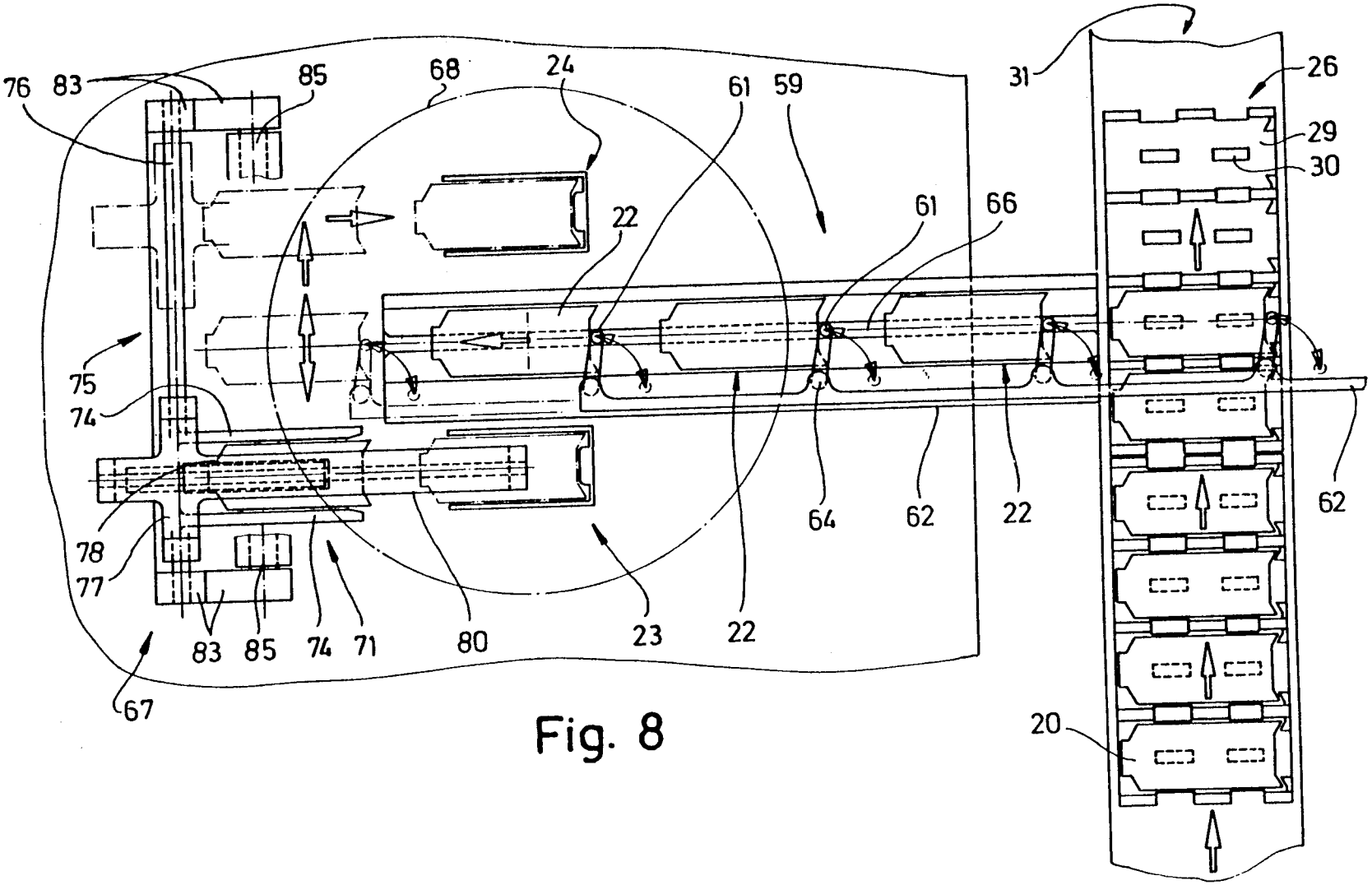
Figure 9:
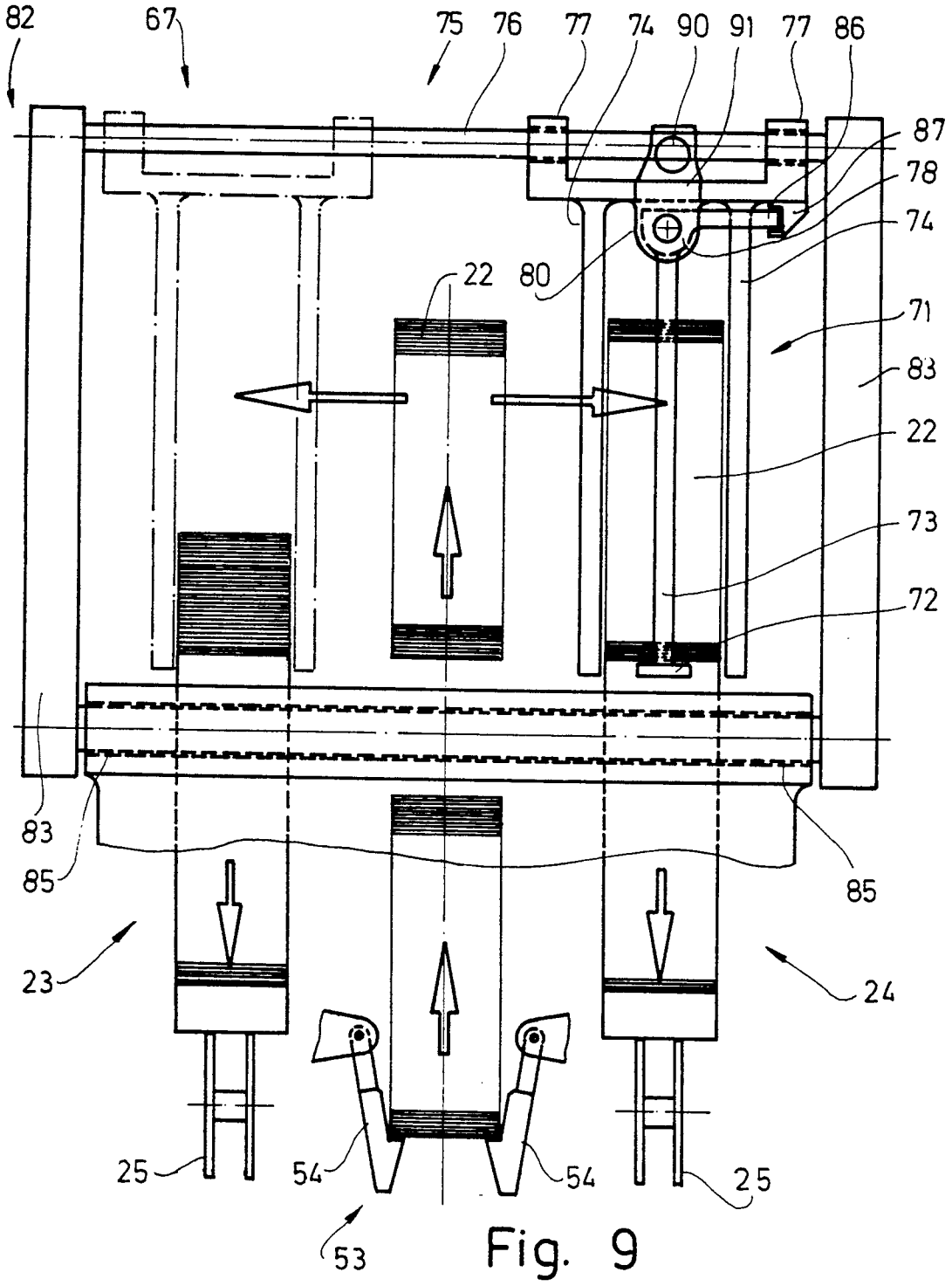
Figure 10:
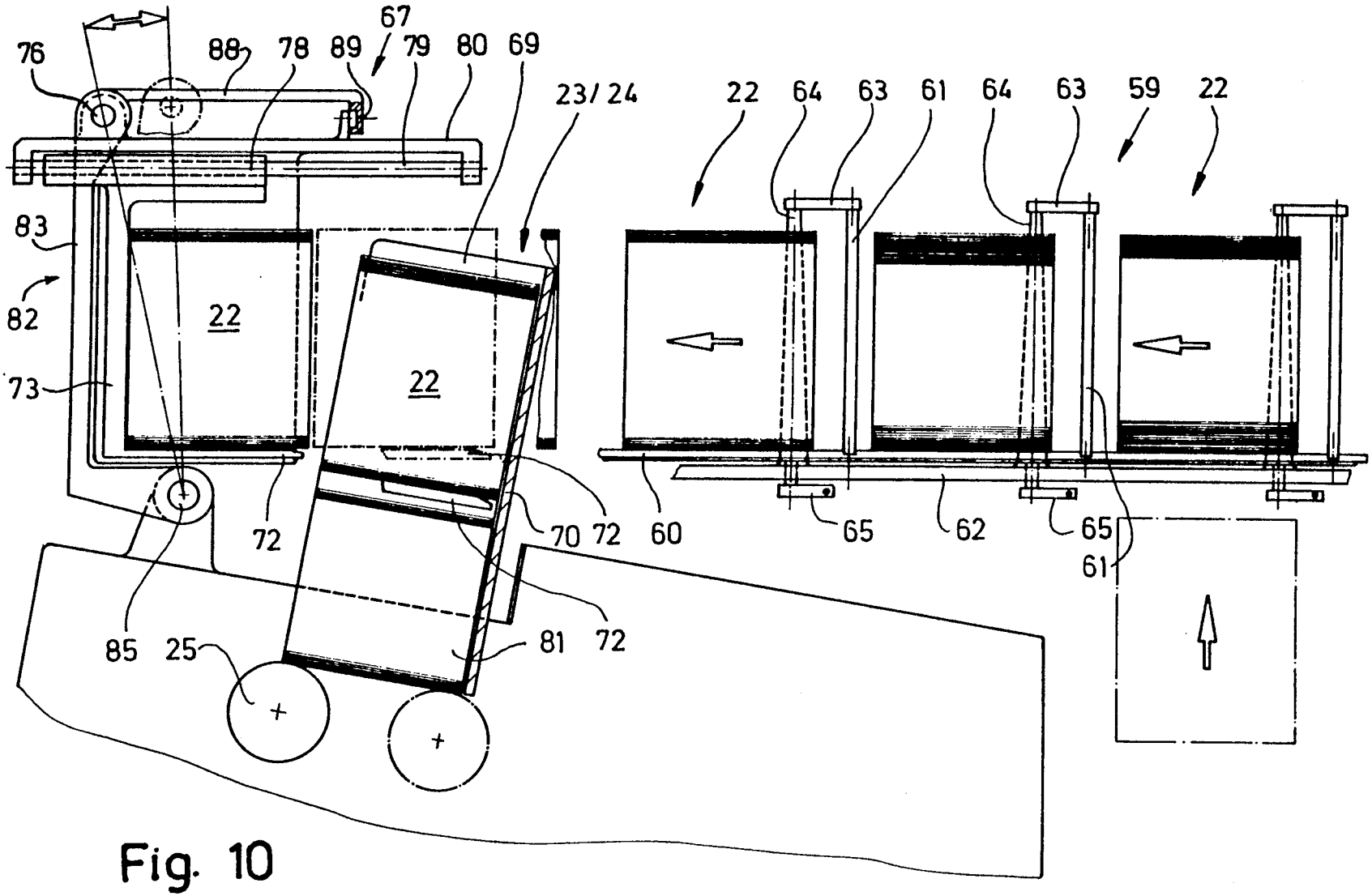
Figure 11:
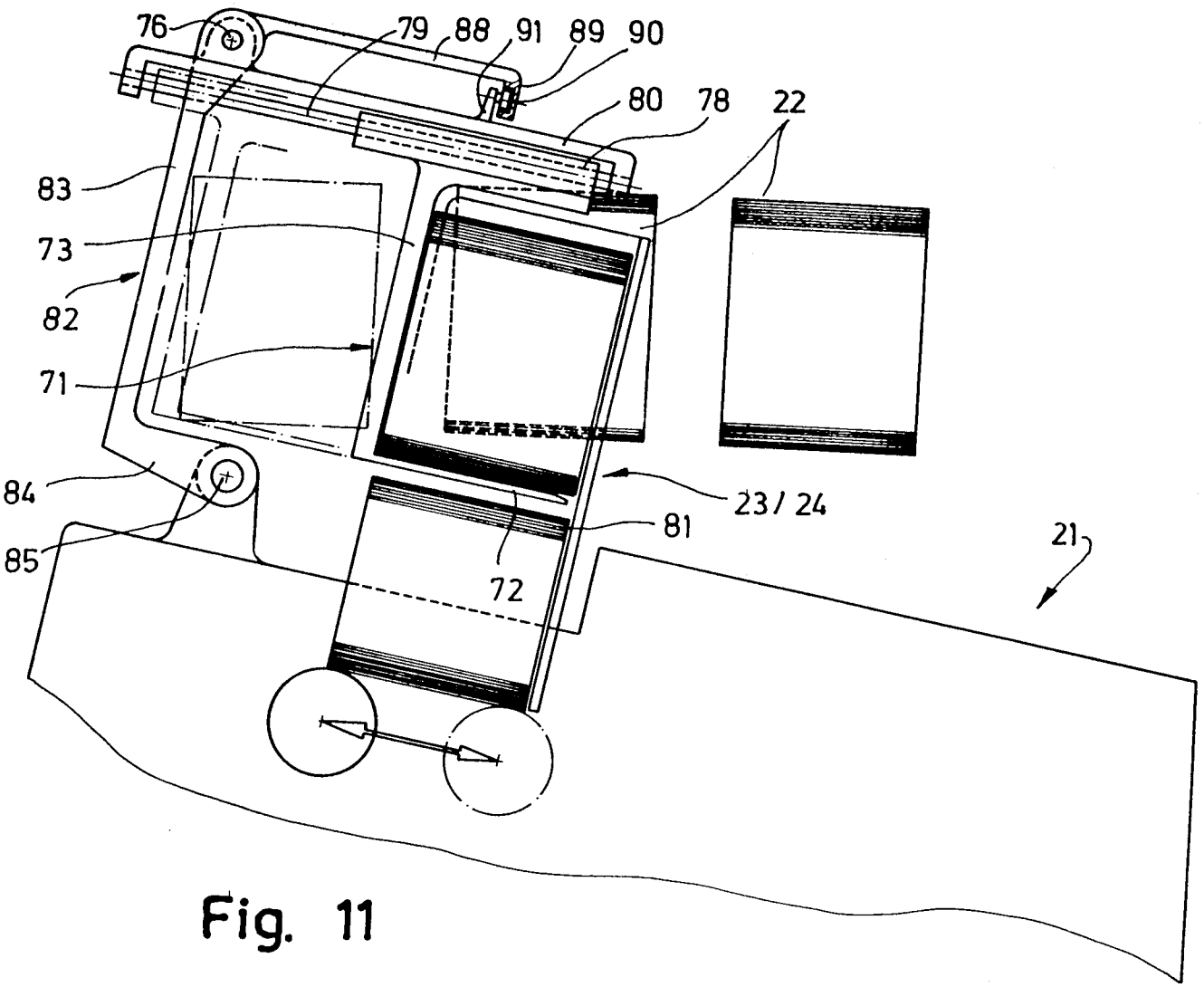

An exemplary embodiment of the invention is explained in detail below by means of the drawings. In these:

FIG. 1 shows a plan view of a container, particularly a cassette for receiving blank stacks, FIG. 2 shows a longitudinal view of a packaging machine with apparatuses for the transport and emptying of cassettes, FIG. 3 shows a plan view of the packaging machine according to FIG. 2, with parts of the transport apparatus, FIG. 4 shows a transverse view of the packaging machine on an enlarged scale, likewise with parts of the transport apparatus, FIG. 5 shows a longitudinal view of a cassette on a cassette conveyor, FIG. 6 shows a transverse view of the detail according to FIG. 5, FIG. 7, shows a side view of details of an upward conveyor for blank stacks, FIG. 8 shows a plan view of a cross-conveyor for blank stacks with a following stack distributor, FIG. 9 shows a transverse view of details of the apparatus according to FIG. 8, FIG. 10 shows a longitudinal view of the details according to FIGS. 8 and 9, FIG. 11 shows a cutout from the representation according to FIG. 10, with conveying members in a changed relative position.

The exemplary embodiment illustrated is concerned with the handling, especially the transport of (pack) blanks 20 in the region of a packaging machine 21. The blanks 20 shown serve for the production of hinge-lid packs for cigarettes.

The blanks are made outside the packaging machine 21, especially in a paper factory, and are supplied stacked, particularly as blank stacks 22. The object is to convey sufficient quantities of blanks 20 or blank stacks 22 to blank magazines of the packaging machine 21. In the exemplary embodiment illustrated, the packaging machine 21 is equipped with two blank magazines 23, 24 of this type. These are designed as a vertical or slightly inclined shaft of U-shaped cross-section. The blanks 20 are extracted from the blank magazines 23, 24 on the underside by means of an extraction member, in the present case a roll-off device 25 of generally known type. The blanks 20 or blank stacks 22 are fed to the blank magazines 23, 24 from above.

The main component of the apparatus for the feeding and handling of the blank stacks 22 is containers, in particular cassettes 26. Several blank stacks 22 are respectively accommodated next to one another in these. In the present case, the cassettes 26 consist of a bottom wall 27, on which the blank stacks 22 rest, and of vertical walls or wall members. These are webs 28 connected to the bottom wall 27. These are so arranged on the bottom wall 27 that several, in particular, in the present case, four chambers 29 are formed next to one another. The chambers 29 are separated from one another by means of webs 28. A blank stack 22 is located in each chamber 29. The cassette 26 and therefore also the chambers 29, are open at the top.

The bottom wall 27 is equipped with rectangular orifice 30. On the one hand, these allow an internested stacking of several empty cassettes 26 for spacesaving transporting away. On the other hand, however, the orifices 30 are so formed and arranged approximately in the mid-plane of the chambers 29 that lifting members can pass through the bottom wall 27 from below, in order to lift the blank stacks 22 out of the chambers 29. The orifices 30 are of rectangular cross-section.

The cassettes 26 are filled with the blank stacks 22 at a suitable location, especially in the paper factory, and are then fed to the packing machine 21. This is assigned a cassette conveyor 31, on which the cassettes are deposited. The cassette conveyor 31 is designed as a band conveyor, in the present case with two conveyor belts 32, 33 arranged at a distance from one another (for example, FIG. 6). The cassettes 26 stand with their edge regions on the conveyor belts 32, 33, so that the respective orifices 30 located at a distance from the edge of the bottom wall 27 are exposed.

The cassette conveyor 31 extends as an elongate conveying member at the rear of the packaging machine 21 immediately next to this and approximately parallel to the (imaginary) longitudinal mid-plane of the latter. A delivery station 34 for depositing individual cassettes 26 is formed at one end of the cassette conveyor 31. Located at the opposite end is a discharge station 35 for emptied cassettes 26. Formed in a region confronting this discharge station 35 is an emptying station 36 in which the blank stacks 22 are extracted from the cassette 26 in succession. The region from the delivery station 34 to the emptying station 36 constitutes a store of considerable capacity for cassettes 26 and blank stacks 22.

The (filled) cassettes can be fed to the delivery station 34 on pallets or other carriers and be deposited on the cassette conveyor 31 here by hand. However, the solution shown in FIGS. 2 and 3 with an automatic transport of the cassettes 26 is more advantageous. Installed above the packaging machine 21, especially on a building ceiling, is a continuous conveyor. This consists of suspended rails 37 and bogey trucks 38 which are movable on the rails 37. Each bogey truck 38 is equipped with a material carrier 39 which is suitable for receiving one cassette 26 at a time. This conveying system arranged "overhead" is preferably designed in a similar way to the conveying system of German Patent Application P 38 20 735.4.

In the region of the packaging machine, vertical conveyors 40, 41 are arranged respectively in the region of the delivery station 34 and of the discharge station 35. These are designed in a similar way to the vertical conveyors of the abovementioned German Patent Application P 38 20 735.4. Cassette holders 43, 44 are movable up and down on a vertical supporting column 42. Each cassette holder 43, 44 is designed so that a cassette 26 is received on horizontal supporting members, for example supporting rods, and can thus be conveyed downwards or upwards next to the supporting column 42. The relative position of the vertical conveyors 40, 41 in relation to the bogey trucks 38 and their material carriers 39, on the one hand, and in relation to the cassette conveyor 31, on the other hand, is selected so that the transfer of the cassettes 26 from one conveyor to the other takes place automatically as a result of relative movement, specifically in the way described in principle in Patent Application P 38 20 735.4.

Accordingly, in the region of the delivery station 34, filled cassettes 26 are automatically deposited on the cassette conveyor 31, whilst emptied cassettes 26 are taken over by the cassette holder 44, likewise automatically, in the discharge station 35 and conveyed upwards, to be taken up by a bogey truck 38 or the material carrier 39.

The blank stacks 22 extracted from the cassettes 26 in the emptying station 36 are first conveyed upwards, moved in a plane above the packaging machine 21 transversely relative to this or transversely relative to the cassette conveyor 31 and finally advanced to the blank magazines 23, 24 as a result of lateral movement (FIG. 8).

For emptying the cassettes 26, these are positioned in the emptying station 36 exactly in relation to a stack lifter 45. For this purpose, formed on the underside of the bottom wall 27 of the cassette 26 are stops 46 which run against a positioning stop 47 introducible into the path of movement of the cassette 26. In the exemplary embodiment illustrated, the stops 46 take the shape of a rear limitation of formed-in depressions 48 in the bottom wall 27. To define the exact relative position of the cassette 26, several, particularly four, positioning stops 47 are arranged on a stop wheel 49 driven to rotate intermittently. The cassette 26 is aligned in such a way that a particular chamber 29 is aligned centrally with the stack lifter 45. After a blank stack 22 has been lifted out, the cassette 26 is transported further by the amount of one stroke, until, after a corresponding quarter rotation of the stop wheel 49, a subsequent positioning stop 47 rests against the following stop 46 of the cassette 26.

The stack lifter 45 consists here of two tappets 50 jointly movable up and down. In the initial position (FIGS. 5 and 6), these are located underneath the cassette 26 or underneath a conveying strand of the cassette conveyor 31, specifically between the two conveyor belts 32, 33 (FIG. 6).

The tappets 50 are so aligned with the cassette 26 that they can pass through two orifices 30 in the bottom wall 27 of the cassette 26, specifically in the middle of a chamber 29. The tappets 50 have a cross-section matched to the orifice 30. As a result of an upward movement of the tappets 50, the blank stack 22 is grasped on the underside and lifted out of the cassette 26 via the open top side of the latter.

The tappets 50 execute only a limited lifting movement, in particular as far as a position of the blank stack 22 located above the cassette 26 (FIG. 7). In this position, the blank stack 22 is taken over by an upward conveyor 53 and moved further upwards.

In the present exemplary embodiment, the tappets 50 are mounted on a common tappet carrier 51 which is itself movable up and down on a vertical guide column 52 connected to the packaging machine 21.

In the present case, the upward conveyor 53 consists of pivotable pawls 54 which engage respectively under the blank stack 22 on the longitudinal sides by means of noses 55. The pawls 54 acting on the two sides of the blank stack 22 are moved jointly upwards. In the present case, for this purpose, each pawl is mounted on a sliding sleeve 56 which is movable up and down along a vertical guide rod 57 by means of members (not shown), for example pressure-medium cylinders. During the upward movement, the blank stack 22 is taken up to a cross-conveyor plane 58.

The vertical blank stacks 22 are conveyed in the cross-conveyor plane 58 above the packaging machine 21 to the front side or to a front region of the latter, specifically by means of a cross-conveyor 59.

The cross-conveyor 59 consists here of a horizontal sliding track 60, on which the blank stacks 22 stand and are shifted intermittently in a sliding manner. For the conveying drive of the blank stacks 22, the cross-conveyor 59 is designed as an intermittent conveyor with a multiplicity of movable drivers engaging respectively on the rear side of the blank stack 22. Here, these are designed as vertical driver rods 61. The height of these is matched to the height of the blank stacks 22, so that the latter are grasped over the entire height.

All the driver rods 61 of the cross-conveyor 59 are actuated simultaneously by means of a common drive. This consists of a common push rod 62 arranged next to the path of movement of the blank stacks 22. It is driven to and fro, specifically each time by the amount of a feed stroke, particularly from the rear initial position represented by unbroken lines in FIG. 8 into the front end position represented by dot-and-dash lines. During this conveying movement, the driver rods 61 are moved into the driver position, approximately centrally on the rear side of a blank stack 22. In the present exemplary embodiment, four blank stacks 22 at a time are grasped by the cross-conveyor 59 and moved further by the amount of one stroke. Each time, a blank stack 22 fed by the upward conveyor 53 is also grasped and conveyed onto the sliding track 60. For the return movement of the cross-conveyor 59 to the initial position (unbroken lines in FIG. 8), the driver rods 61 are retracted from the position on the rear side of the blank stack 22 and pivoted into a lateral position next to the path of movement of the blank stacks 22.

For this purpose, the driver rods 61 are mounted respectively on a pivoting arm 63 above the plane of movement of the blank stacks 22. The pivoting arm 63 is itself connected to a vertical rotary rod 64 which is attached rotatably to the push rod 62. The rotary rods 64 are pivoted jointly, specifically each via a pivoting shackle 65 arranged on the lower end of the rotary rod 64 and underneath the push rod 62. This pivoting shackle 65 is itself in a plane below the sliding track 60. The pivoting shackles 65 can be actuated in a suitable way, for example by means of pressure-medium cylinders.

The driver rods 61 mounted only at the upper end, in particular connected to the pivoting arm 63, can be extended at the bottom to below the cross-conveyor plane 58, so that the blank stack 22 is grasped reliably over the entire height. For this reason, the sliding track 60 is equipped with a longitudinal slot 66, in which the lower ends of the driver rods 61 run during the feed stroke. Formed in the sliding tracks 60 are arcuate slots which adjoin the longitudinal slot 66 and which allow the driver rods 61 to come out of the longitudinal slot 66 when the driver rods 61 are pivoted into the position for the return movement of the push rod 62. The arcuate slots are not shown here for the sake of clarity.

The cross-conveyor 59 transports the blank stacks 22 intermittently to a lateral distributor 67. The function of this is to transport the intermittently fed blank stacks 22 transversely relative to the cross-conveyor 59 into a position in front of one blank magazine 23, 24 or the other and then transfer them to the respective blank magazine 23 or 24. The blank magazines 23, 24 are arranged above a disc-shaped folding turret 68 which, in the present exemplary embodiment, rotates about a vertical axis. The blank magazines 23, 24 lie on both sides of the cross-conveyor 59 with an open side directed towards the front of the packaging machine 21. The blank magazines 23, 24 are of U-shaped cross-section with side walls 69 and an end wall 70. The blank magazines 23, 24 are open at the top. The already mentioned roll-off device 25 as an extraction member for the blanks 20 is located on the underside. The blank magazines 23, 24 are arranged slightly inclined.

The lateral distributor 67 contains a stack pocket 71. A blank stack 22, when in an approximately central position aligned with the cross-conveyor 59, is conveyed into this lateral distributor 67 during each feed stroke of the cross-conveyor 59. For this purpose, the stack pocket 71 is open on the side facing the cross-conveyor 59.

The blank stacks 22 stand on a supporting bottom 72 in the stack pocket 71. In the exemplary embodiment illustrated (FIG. 9), the supporting bottom 72 is designed as a relatively narrow web which extends in the middle of the stack pocket 71. Located on the supporting bottom 72 is a vertical rear wall 73 which is likewise designed as a relatively narrow structure (FIG. 9). Furthermore, the stack pocket 71 is equipped with pocket side walls 74 on both sides of the blank stack 22.

The stack pocket 71, as a supporting member for a blank stack 22, is mounted on a transverse guide 75. This consists essentially of a supporting rod 76, on which the stack pocket 71 is mounted shiftably by means of a rotary guide 77. By shifting the rotary guide 77 on the supporting rod 76, the stack pocket 71 can be moved either in front of the end of the cross-conveyor 59 or in front of one of the blank magazines 23, 24.

Furthermore, the stack pocket 71 or a supporting unit of this, consisting of supporting bottom 72 and rear wall 73, is movable in a direction parallel to the cross-conveyor 59. This further movement of part of the stack pocket 71 serves for advancing a blank stack 22 to the blank magazine 23, 24. For this purpose, the rear wall 73 connected to the supporting bottom 72 is mounted shiftably via a bearing sleeve 78 on a longitudinal guide, particularly on a longitudinal rod 79. This is directed (approximately) parallel to the cross-conveyor 59. The longitudinal rod 79 is held by a supporting frame, particularly by a supporting bar 80.

To transfer a blank stack 22 to a blank magazine 23, 24, the stack pocket 71 or its supporting bottom 72 with the rear wall 73, in the position aligned with the open side of the blank magazine 23, 24, is shifted towards the latter, that is to say parallel to the cross-conveyor 59. The pocket side walls 74 connected to the supporting guide 77 in the present case remain in the initial position.

The blank stack 22 is moved, together with the supporting bottom 72, into the magazine 23, 24. For the transfer of the blank stack 22, the supporting bottom 72, together with rear wall 73, is tilted into an oblique position (unbroken lines in FIGS. 10 and 11). In this position, the blank stack 22 is aligned with the oblique position of the blank magazine 23, 24. As a result of the retraction of the supporting bottom 72 in the oblique position, the blank stack 22 is transferred to the blank magazine 23, 24, particularly to a residual stack 81 in the magazine 23, 24. The transfer of the new blank stack 22 therefore takes place only after the blank magazine 23, 24 has been emptied, with the exception of the residual stack 81 which ends underneath the supporting bottom 72. The blank stack 22 released as a result of the retraction of the supporting bottom 72 covers a short falling height until it comes to rest on the residual stack 81. The stack pocket 71 is then moved back into the vertical position and moved in front of the cross-conveyor 59 for the reception of a further blank stack 22.

To execute the above-described tilting movement of the blank stack 22 in the blank magazine 23, 24, the stack pocket 71 is mounted on a tiltable supporting frame 82. This consists of lateral vertical supporting legs 83. Their upper ends are connected to one another by means of the transversely directed supporting rod 76. The lower ends of the supporting legs 83 are mounted pivotably via an angled portion 84, particularly via a pivot bearing 85 connected to the machine stand of the packaging machine 21.

The entire supporting frame described is accordingly tiltable about the pivot bearing 85, specifically after the introduction of a blank stack 22, together with the supporting bottom 72, into a blank magazine 23, 24. The tilting movement amounts here to approximately 10° .

The supporting bar 80, as a supporting member for the stack pocket 71, is braced on the supporting frame 82 in such a way that, despite the shiftability of the supporting guide 77 on the supporting rod 76, the supporting bar 80 acts as a projecting supporting arm. For this purpose, an extension arm 88 is connected laterally to the supporting frame 82, particularly to each of the supporting legs 83. These extension arms 88 act as rigid supporting members. The free ends of the extension arms 88 are connected to one another by means of a transversely directed supporting rail 89. The supporting bar 80 is braced shiftably in this, in the present case by means of a stay roller 90 which is connected to the top side of the supporting bar 80 via an extension 91. The supporting bar 80 can thus be moved, together with the stack pocket 71, transversely relative to the cross-conveyor 59, free of torsion, as a result of the shift of the supporting guide 77 on the supporting rod 76.

Those parts of the stack pocket 71, particularly the supporting bottom 72 and rear wall 73, which are mounted shiftably on the longitudinal rod 79 by means of the bearing sleeve 78 are secured against rotational movements about the longitudinal axis of the longitudinal rod 79. In the exemplary embodiment illustrated (FIG. 9), a stay leg 86 is attached laterally to the bearing sleeve 78 and runs with its free end in a guide 87. This is connected to the supporting guide 77 and extends in the direction of movement of the bearing sleeve 78. The end of the stay leg 86 can be braced in the groove of the guide 87 by means of a track roller (not shown).

Thus, by means of the lateral distributor 67 the blank stack 22 received in a middle position of the stack pocket 71 is, as required, moved as a result of a transverse shift of the stack pocket 71 on the supporting rod 76 in one direction or the other in front of one blank magazine 23, 24 or the other and transferred to this in the way described. The steps of movement of the stack pocket 71 are matched to the feed stroke of the cross-conveyor 79, in such a way that the particular emptied stack pocket 71 is prepared for the reception of a blank stack 22 in the extension of the cross-conveyor 59.

I claim:

1. An apparatus for feeding pack blanks to a blank magazine of a packaging machine, especially for producing hinge-lid packs for cigarettes, comprising:

a) a plurality of transport cassettes (26) each having several chambers (29), each of said chambers (29) being capable of holding at least one blank stack (22);

b) an above ground conveyor means (37, 38) for transporting the cassettes (26) in a first step;

c) a vertical conveyor means (40) for receiving the cassettes (26) from said above ground conveyor means (37, 38) and feeding the cassettes to a delivery station (34) in a second step;

d) a cassette conveyor means (31), having the delivery station (334), an emptying station (36) and a discharge station (35), and for conveying a corresponding one of the cassettes (26) being in the delivery station (34) to the emptying station (36) and after emptying to the discharge station (35); and e) a vertical conveyor means (41) for receiving the one cassette which is in the discharge station (335) and transporting the one cassette with an upwardly directed movement; so that f) said above ground conveyor means (37, 38) receives the one cassette (26) which has been upwardly transported by the vertical conveyor means (41) and transports the one cassette away.

2. Apparatus according to claim 1, characterized in that the cassette conveyor means (31) is arranged at a rear of the packaging machine (21) and extends in a longitudinal direction of the packing machine and parallel to an longitudinal mid-plane.

3. Apparatus according to claim 1, characterized in that the cassette conveyor means (31) is designed as an intermittently driven endless conveyor, consisting of two conveyor belts (32, 33) which are arranged at a distance from one another and on which the cassettes (26) stand with their edge regions.

4. Apparatus according to claim 1, characterized in that, in the emptying station (36), the blank stacks (22) are lifted individually by a stack lifter (45) out of the cassette (26) to be emptied and can be conveyed upwards as far as a cross-conveyor plane (58).

5. Apparatus according to claim 4, characterized in that the stack lifter (45) has tappets, especially two simultaneously actuated tappets (50) which are arranged at a distance from one another and which pass from below through orifices (30) in a bottom wall (27) of the cassette (26) and, as a result of an upward movement, lift a blank stack (22) out of each cassette (26).

6. Apparatus according to claim 5, characterized in that the blank stacks (22) lifted out of the cassettes (26) by the stack lifter (45) are fed to an upward conveyor (533), for transporting the blank stacks (22) upwards as far as the cross-conveyor plane (58), the upward conveyor (53) having drivers in the form of engaging on an underside of a blank stack (22) on two opposite sides.

7. Apparatus according to claim 4, further comprising a cross--conveyor (59) for conveying the blanks tacks in a cross-conveyor plane (58) above the packaging machine (21) from a rear of the packaging machine transversely relative to the cassette conveyor means (31) to a front region of the packing machine (21) and from there to a blank magazine, there being provided two blank magazines (23, 24) which are arranged at a distance from one another and to which blank stacks (22) can be fed alternately by a transverse distributor (67).

8. Apparatus according to claim 7, characterized in that the blank stacks (22) are driven intermittently by the cross-conveyor (59), and the blank stacks (22) stand on a sliding track (60) at a distance from one another and are conveyed by an amount of a step of movement by vertical drivers in the form of a driver rods engaging on a rear side.

9. Apparatus according to claim 8, characterized in that the driver rods (61) are arranged on a common actuating member movable to and fro on a push rod (62) arranged offset relative to the sliding track (60).

10. Apparatus according to claim 8, characterized in that the blank stacks (22) are received, at the end of the cross-conveyor (59), by the transverse distributor (67) which, as required, conveys the blank stack (22) in front of one blank magazine (23, 24) or the other as a result of a conveyance directed to one side or the other.

11. Apparatus according to claim 10, characterized in that the transverse distributor (67) is equipped with a receptacle, in the form of a stack pocket (71) for a blank stack (22), into which the blank stack (22), when in a relative position aligned with the cross-conveyor (59), in conveyed by the cross-conveyor (59).

12. Apparatus according to claim 10, characterized in that the stack packet for a blank stack (22) is shiftable, on a transverse guide (75) directed transversely relative to the cross-conveyor (59), between a mid-position for receiving a blank stack (22) from the cross-conveyor (59) and an end position aligned with a blank magazine (23, 24).

13. Apparatus according to claim 11, characterized in that the stack pocket 71 for the blank stack (22), in the position aligned with a blank magazine (23, 24), is movable in a direction of the blank magazine (23,24) for a transfer of the blank stack (22).

14. Apparatus according to claim 13, characterized in that at least one supporting bottom (72) of the stack pocket (71), together with a blank stack (22), is introduced into the blank magazine (23, 24) open on a side facing the lateral distributor (67), for the transfer of the blank stack (22).

15. Apparatus according to claim 14, characterized in that said at least one supporting bottom (72) of the stack pocket (71)), together with a blank stack (22), is tiltable for the transfer of the blank stack to a blank magazine (23, 24), in such a way that the supporting bottom (72) of the stack pocket (71) is inclined downwards in a direction of the open side.

16. Apparatus according to claim 15, characterized in that the stack pocket (71) as a whole, together with a guide for shifting it, is mounted tiltably, on a tiltable supporting frame (82) connected to a machine stand of the packaging machine (21).

17. Apparatus according to claim 1, wherein said cassette conveyor means moves each of the cassettes (26) in steps in the emptying station (36), such that the chambers (29) of each of the cassettes (26) holding one blank stack (22) each successively reach a region of a stack lifter (45).

* * * * *